US005841585A

United States Patent [19]

Katou et al.

[11] Patent Number: 5,841,585

[45] Date of Patent: Nov. 24, 1998

[54] LIGHT PATTERN PROJECTING DEVICE

[75] Inventors: Hideyuki Katou; Atsushi Ishii, both of Tokyo, Japan

[73] Assignee: Tomy Company, Ltd., Tokyo, Japan

[21] Appl. No.: 646,638

[22] Filed: May 8, 1996

[30] Foreign Application Priority Data

Dec. 28, 1995 [JP] Japan ..... 7-014599

[51] Int. Cl.[6] ..... G02B 23/00

[52] U.S. Cl. ..... 359/616

[58] Field of Search ..... 359/616, 617

[56] References Cited

U.S. PATENT DOCUMENTS

| | | | |
|---|---|---|---|
| 4,776,653 | 10/1988 | Kaplan | 350/4.1 |
| 5,442,524 | 8/1995 | Farmer | 362/324 |
| 5,494,445 | 2/1996 | Sekiguchi et al. | 434/365 |

FOREIGN PATENT DOCUMENTS

| | | |
|---|---|---|
| 957122 | 1/1962 | United Kingdom . |
| 1 106 072 | 4/1965 | United Kingdom . |
| 1 203 464 | 6/1967 | United Kingdom . |
| 2 258 165 | 7/1992 | United Kingdom . |

*Primary Examiner*—Daniel P. Malley
*Attorney, Agent, or Firm*—Staas & Halsey

[57] ABSTRACT

A toy for projecting two, superimposed designs having a first design displaying body formed in a cylinder and being rotatable about a center axis, a mechanism for rotating and driving the first design displaying body, a second design displaying body fixedly disposed either inside or outside of the first design displaying body and located within the vicinity of at least a portion of the first design displaying body, and a light source inside the first design displaying body illuminating same and the second design displaying body from the inside for projecting superimposed designs.

11 Claims, 9 Drawing Sheets

2a
10c
10a
10b
14
15
16
41
40
50
51
37a
37b
38
34
9
33
32
35a
35b
36a
36b
36
30
31
6
17
4
42
11
12
13
20
24
5a
5
23
21
SW

LIGHT PATTERN PROJECTING DEVICE

BACKGROUND AND SUMMARY OF THE INVENTION

The present invention relates generally to light pattern projecting devices, and more particularly to such devices capable of projecting two different designs or pattern while superimposing same.

Toys for projecting two superimposed designs have typically included a light source, an opaque member having a light transmitting portion through which light from the source is transmitted, a member having a light transmitting pattern which is arranged in a direction other than the direction in which the transparent portion is positioned, a mirror for reflecting the pattern and a focusing mechanism between the mirror and the member having the pattern, such that light reflected from the light transmitting portion and the pattern reflected from the mirror are projected on the same plane. In such an arrangement, a lens and a lens moving mechanism are necessary for focusing and a mirror is necessary to superimpose the designs. The result is complicated and costly in construction. Still further, since the background is usually somewhat fuzzy, the desired relative animation effect is quite short.

It is, therefore, an object of the present invention to provide a toy light projecting mechanism for producing realistic animation effects with a construction that is simple and inexpensive.

In accordance with the principles of the present invention for projecting two designs while superimposing same, there are employed a first design displaying body within a cylinder and being rotatable about an axis, a mechanism for rotating the first design displaying body, a second design displaying body located either outside or inside of the first design displaying body, and a source of light inside the first design displaying body for illuminating same and the second design displaying body from the inside for projecting superimposed designs. There is also provided a dome-like milk white screen on which the design of at least the first displaying body is projected. Since the first and second design displaying bodies are close to each other, the designs are projected by resolution of the same degree.

DESCRIPTION OF THE PREFERRED EMBODIMENTS

Figure 1:
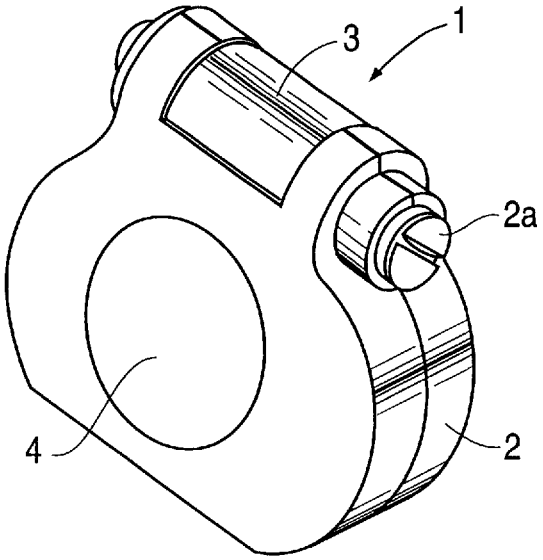
FIG. 1 is a perspective view of the light projecting toy of the present invention.
Figure 4:
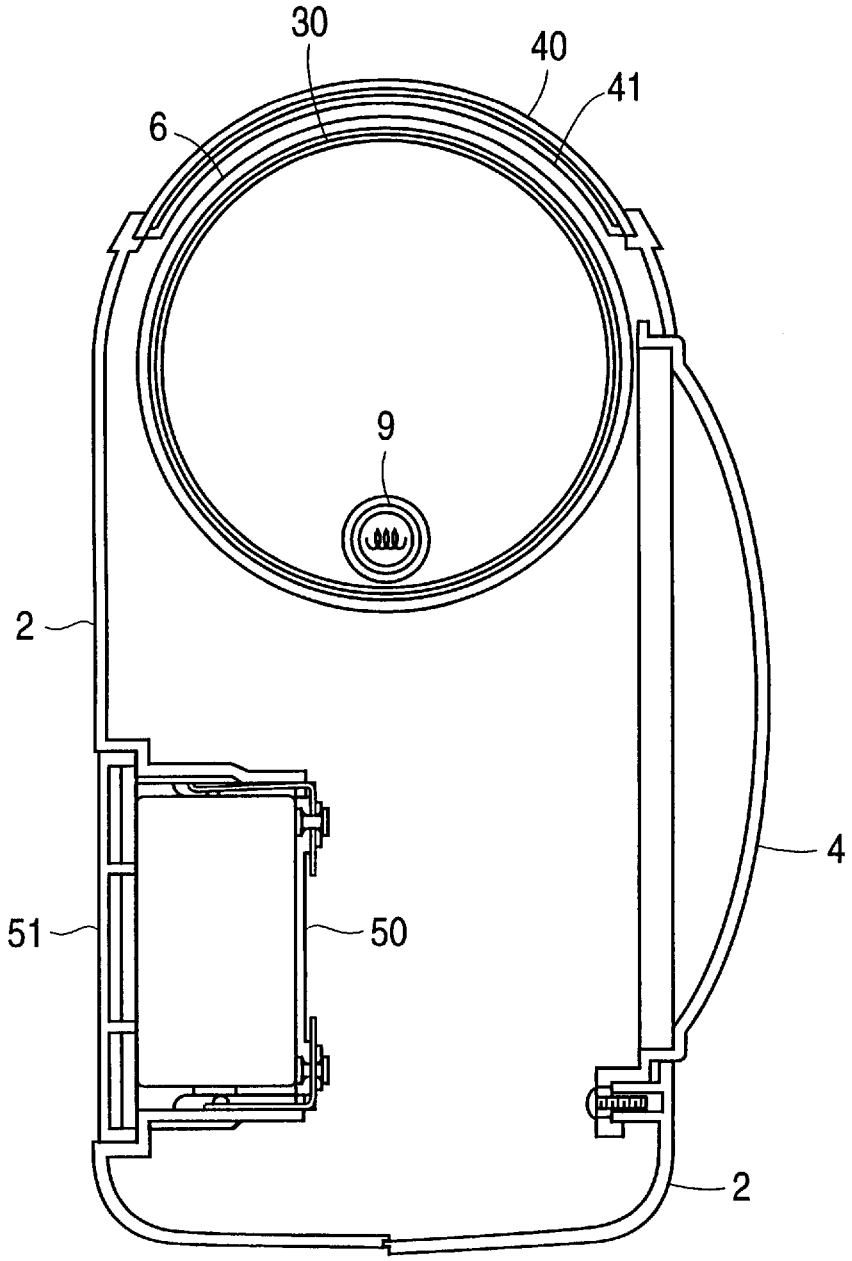
FIG. 4 is a left-side elevational view of the projecting toy with a portion thereof removed.

The light projecting toy of the present invention is generally designated by the reference numeral 1 in FIG. 1. The body 2 of the projecting toy 1 is provided with a dial 2*a*. A window 3 is provided at the top of the body 2 while a screen 4 is illuminated from the inside by a light source or bulb 9, as seen in FIG. 4. Transparent films 30 and 34, depicted in FIG. 4, are positioned inside of the window 3. By rotating the dial 2*a*, a predetermined amount and then releasing same it is possible to project the superimposed designs of the transparent films 30 and 41 onto the ceiling or walls of a room while the design of transparent film 30 is projected on the screen 4.

As seen in FIGS. 2–3 and 5–6, the dial 2*a* is coupled to the input shaft 5*a* (FIG. 5) of a music box unit 5 through clutch pieces 10*a*, 10*b*, the rotating body 11 and the rod 12. Movement of the dial 2*a* causes a windup spring (not shown) disposed in the music box unit 5 to be wound. The windup spring serves as a power source for the music box and as a driving source for the transparent, rotating cylinder 6 referred to hereinafter.

Figure 6A:
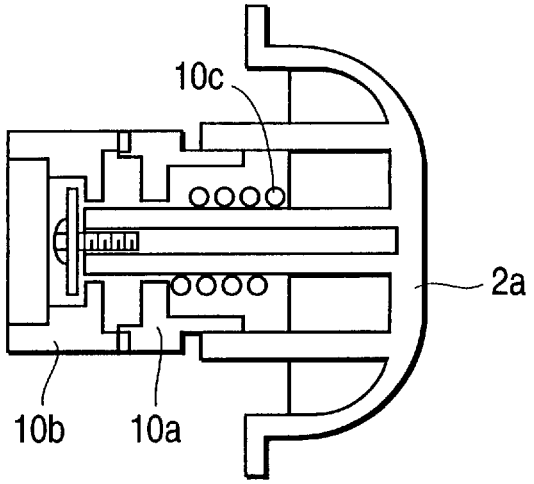
FIGS. 6*a* and 6*b* are elevational views of the dial and its operating mechanism.
Figure 6B:
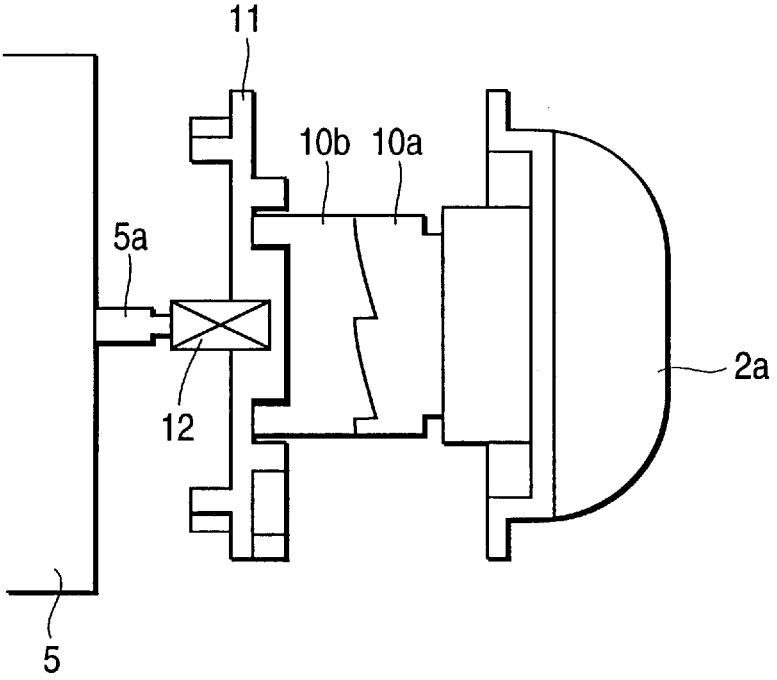

As seen in FIGS. 6*a* and 6*b* the clutch pieces 10*a* and 10*b* abut each other because of the action of the compression spring 10*c*. The two clutch pieces 10*a* and 10*b* thereby form a one-way clutch for transmitting power to the music box unit 5.

Figures 5A, 5B:
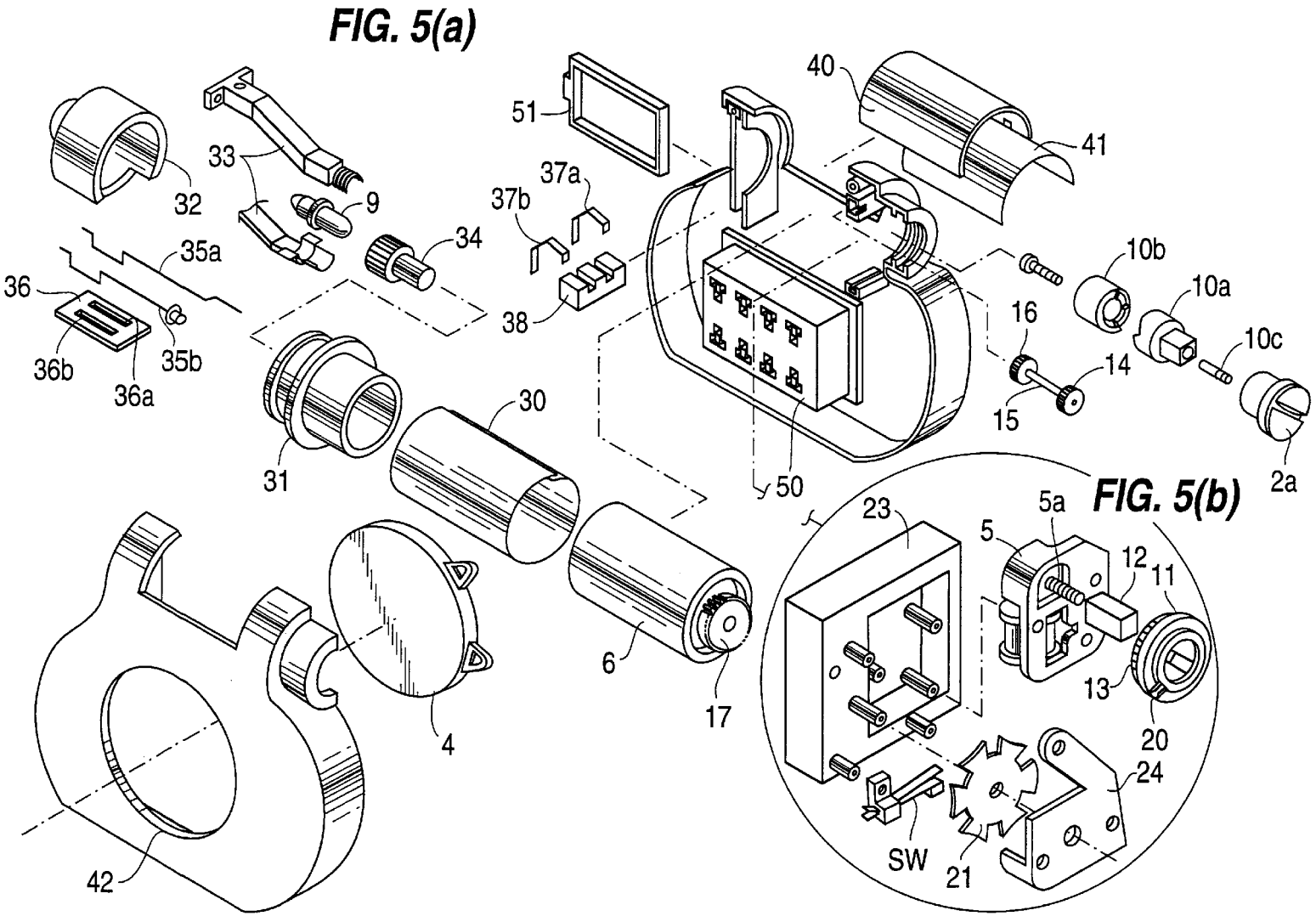
FIG. 5 is an exploded perspective view of the projecting toy.
Figure 7A:
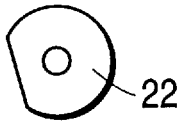
FIGS. 7*a*–7*f* are diagrams illustrating the switching mechanism of the projecting toy.

As seen in FIG. 5, a gear 13 is disposed on the rear surface of the rotating body 11 and engages the gear 14. The shaft 15 is also provided with a gear 16 which engages a gear 17 disposed on the transparent, rotating cylinder 6. The windup spring located in the music box unit 5 and the gears 13, 14, 16 and 17 operate as a rotating, driving mechanism for the transparent cylinder 6. A Geneva stop-lever 20 is provided on the surface of the rotating body and engages the Geneva gear 21. When the body 11 rotates one revolution, the Geneva gear 21 rotates one tooth. A cam 22, as seen in FIG. 7*a*, having a portion of its circular circumference cut by a straight line is provided on the rear surface of the Geneva gear 21. The cam 22 operates to turn on and off a leaf switch SW causing the bulb 9 (FIG. 8) to flicker. From FIGS. 7*b*–7*f* it will be apparent that the leaf switch SW is turned on at the arc portion of the cam 22 and turned off at the chord portion of the cam 22 (shown in dotted lines).

Figure 2:
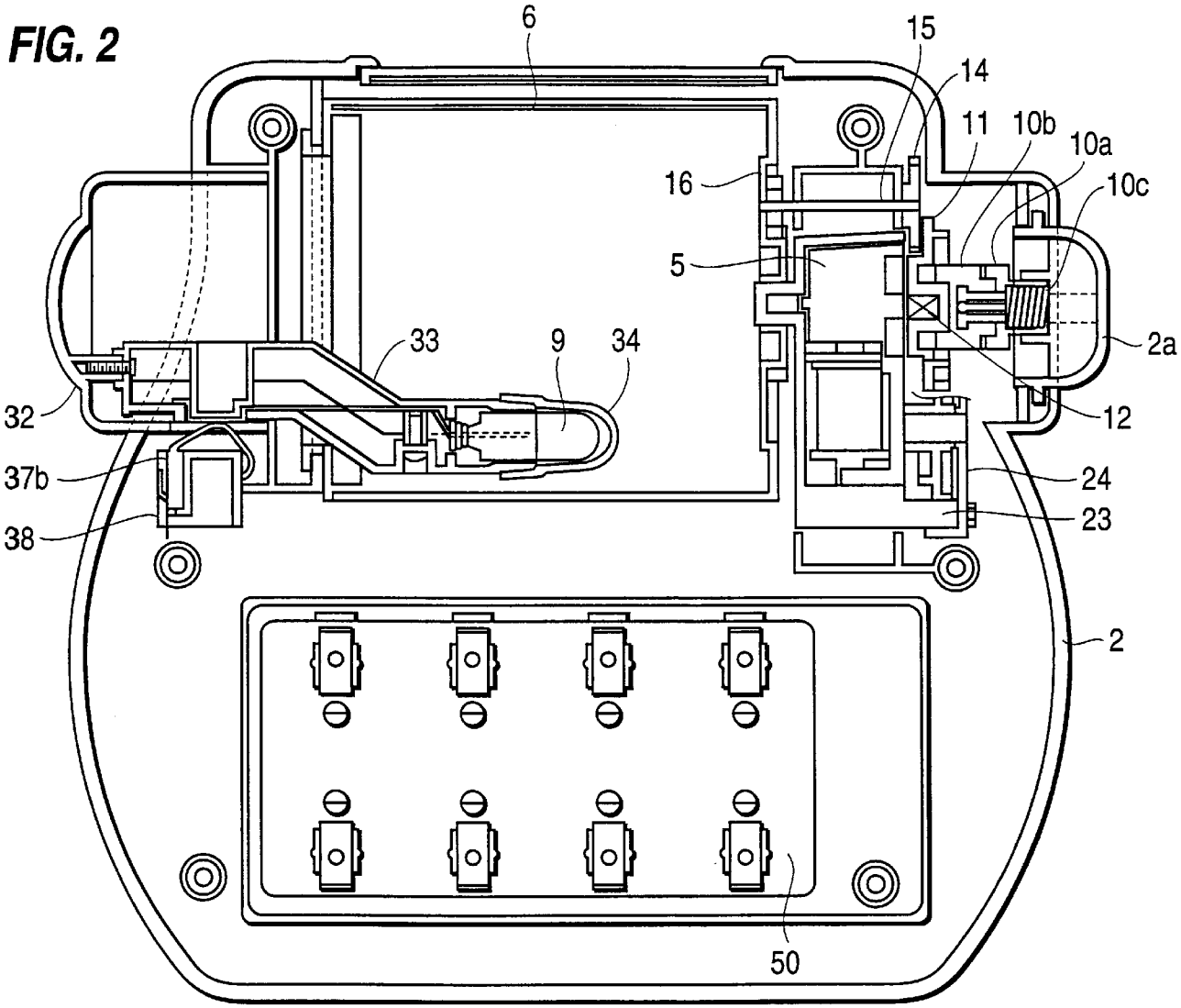
FIG. 2 is a front elevational view of the projecting toy with the front cover thereof removed.

In FIGS. 2 and 5 the reference numeral 23 designates the frame of a music box unit, while the reference numeral 24 designates the frame of the Geneva gear assembly.

Figure 9A:
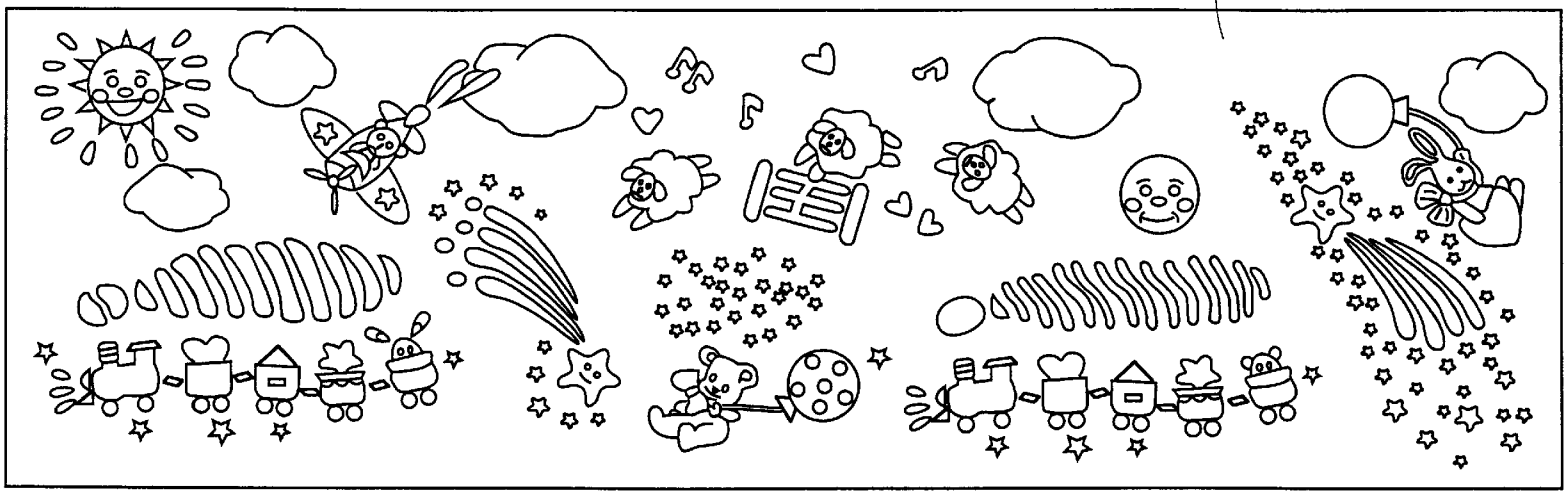
FIGS. 9*a* and 9*b* are views depicting the designs associated with the projecting toy.

As seen in FIG. 5, the transparent film 30 is positioned within the rotating cylinder 6 in crumpled fashion. The transparent film 30 constitutes a first rotational displaying body and, as seen in FIG. 9*a* is provided with designs of a locomotive, smoke, the sun, the moon, and an airplane.

A cylindrical receiving part 31, as seen in FIG. 5, fits within one end of the transparent rotating body 6 which rotatably supports the bearing parts 31 on the main body 2.

Figure 3:
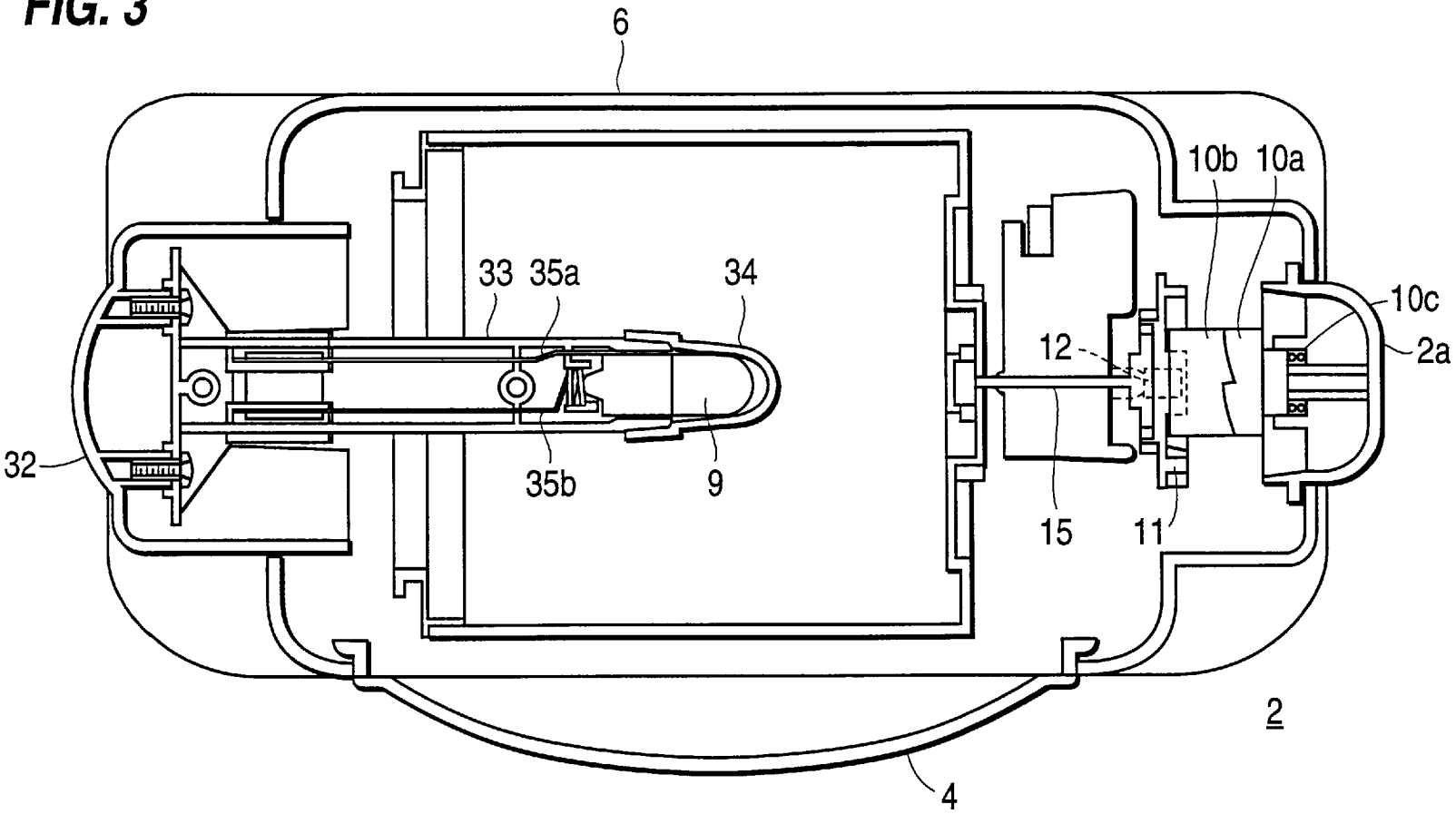
FIG. 3 is a top plan view of the projecting toy with an upper portion there removed.

As seen in FIGS. 2, 3 and 5, the light source receiving part 32 is outside of the cylinder receiving part 31. A bulb frame 33 consisting of upper and lower parts is attached to the light source receiving part 32. The bulb 9 is positioned within the cover 34 which is attached to the leading end of the bulb frame 33. Contact wires 35*a* and 35*b* for supplying electricity to the bulb 9 are appropriately arranged within the frame 33. Folded portions of the contact wires 35*a* and 35*b* are positioned within the slits 36*a* and 36*b* (FIG. 5) of the contact parts 36 and engage the contact plates 37*a* and 37*b* arranged therebelow. In this connection, it is noted that the reference numeral 38, as seen in FIGS. 2 and 5, designates contact plate receiving parts for supporting the contact plates 37*a* and 37*b*.

Figure 9B:
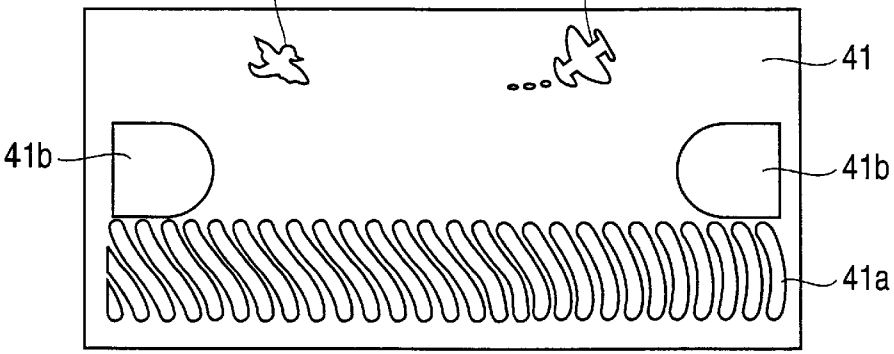

An arch-like transparent plate 40 is disposed on the window 3 of the main body 2. The transparent film 41 is positioned inside the plate 40. As can be seen in FIG. 9*b*,the transparent film 41 is provided with designs of waves, a bird and an airplane. The wave design 41*a* is positioned such that the transparent film 41 is superimposed on a smoke design on the transparent film 30. Accordingly, when the transparent cylinder 6 rotates, the wave design 41*a* and the smoke design are superimposed forming a moire. In addition, the wave design 41*a* and the stars of the transparent film 30 are superimposed producing the twinkling of stars. The tong piece-like design 41*b* is located on the transparent film 41 at a position where it is superimposed with the moon design of the transparent film 30. The tong piece-like design 41*b* is thus superimposed on the moon design such that as the transparent rotating cylinder rotates it appears that the moon is waning and waxing. Still further, the bird design 41*c* and the airplane design 41*d* are superimposed to the moving design of the transparent film 30 such that when the cylinder 6 rotates the bird appears to be flying.

As seen in FIG. 5, a circular opening 42 is provided in the front portion of the main body and a dome-like screen 4 is fitted within the opening 42. The dome-like screen 4 is milk white in color. The design which is projected onto the screen can thereby easily be seen.

As seen in FIGS. 2, 4 and 5, a battery box 50 is incorporated into the rear portion of the main body 2 and includes a lid 51 which forms a portion of the back plate of the main body 2.

Operation of the light projecting toy of the present invention will now be described.

Figure 7B:
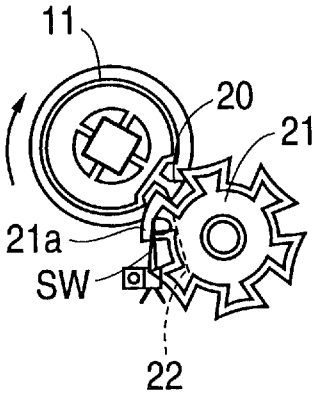
Figure 7C:
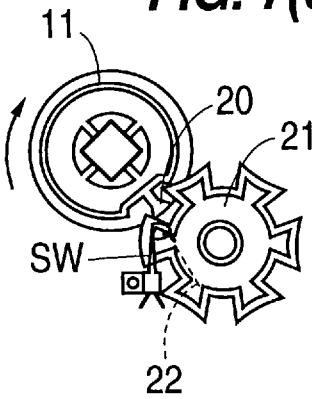
Figure 7D:
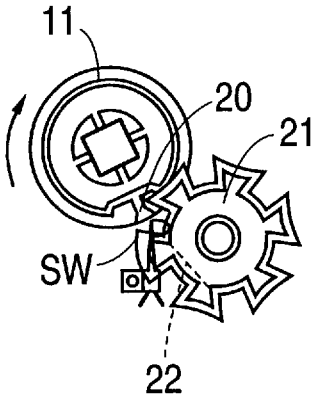
Figure 7E:
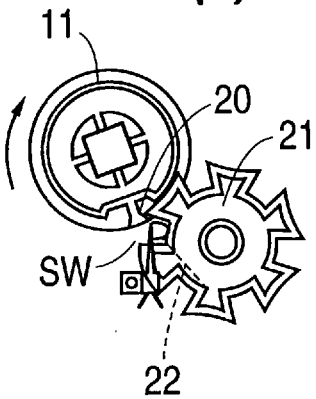
Figure 7F:
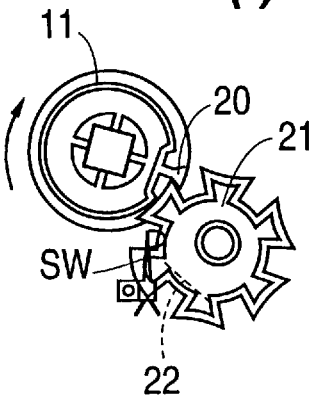
Figure 8:
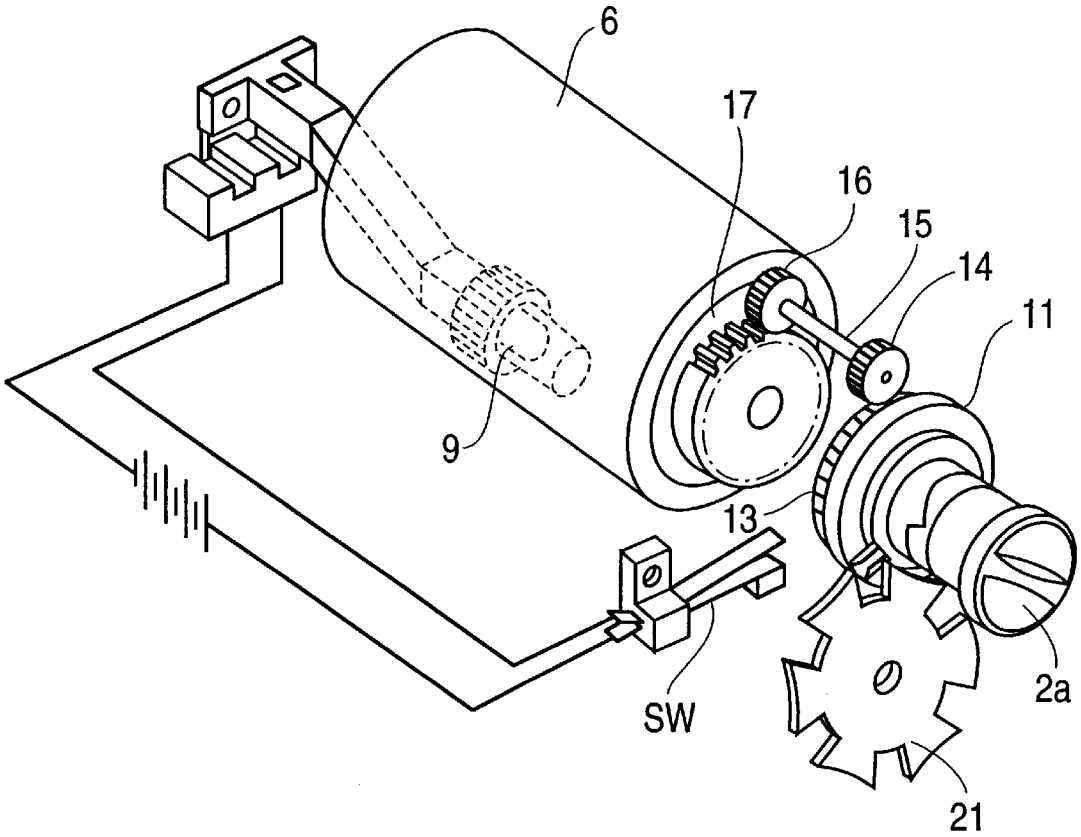
FIG. 8 is a perspective view of a portion of the switching and lighting mechanisms of the projecting toy.

First, the dial 2 is rotated clockwise. The spring located in the music box unit 5 is wound through two of the clutch pieces 10*a* and 10*b*, the rotating body 11 and the square rod 12. When the dial 2*a* is released the wind up spring is thereby released. The music box begins to play and the body 11 rotates, the power thereof being transmitted to the gear 17 through the gears 13, 14 and 16, thus rotating the transparent cylinder 6. When the cylinder 6 rotates, the transparent film 30 located therein also rotates. This rotation continues until the Geneva stop lever 20 expands outside of the Geneva gear 21 abutting the side surface of the teeth 21*a*, as seen in FIG. 7*b*.

The rotation of the dial 2*a* causes the body 11 to rotate along with the Geneva gear 21 and cam 22 such that the contacts of the leaf switch SW engage each other lighting the bulb 9. The bulb 9 continues to illuminate until the leaf switch SW is turned off. When the transparent film 30 is rotating and the bulb 9 is illuminated, the superimposed designs on the transparent films 30 and 41 are projected onto the ceiling or walls while the design of the transparent film 30 is projected onto the screen 4.

Since the transparent films 30 and 41 are close to each other their designs are projected by the resolution of the same degree. Since the transparent film 30 is moved, relative animation is realized. The moire can be made to appear by the transparent films 30 and 41. Because of the milk white screen 4, the design projected thereon can easily be seen.

Although one embodiment of the present invention has been described it will be apparent that the scope of invention is not limited to this embodiment and that various modifications may be made without departing from the principles of the present invention. By way of exemplification only, the designs may be displayed directly on the transparent rotating cylinder 6 and the transparent plate 40 rather than on the film 30 and film 41. Moreover, although the transparent film 41 is disclosed as being outside of the transparent film 30 it may be on the inside thereof. Still further, although it is disclosed that the transparent film 30 is formed as a cylinder and the transparent film 41 is formed as an arch, both may be formed as cylinders.

What is claimed is:

1. A toy for projecting two designs and superimposing same, comprising:

a first design displaying body mounted to rotate about an axis;

means for rotating the first design displaying body about the axis;

a second design displaying body overlaying at least a portion of the first design displaying body;

a light source for illuminating said first and second design displaying bodies and for projecting superimposed designs of said first and second,design displaying bodies;

wherein two designs of a first design displaying body and a second design displaying body, respectively, are projected so that a relative animation effect is achieved and a moire is formed by the superposition of said two designs of said first and second design displaying bodies.

2. A toy as in claim 1, wherein said first design displaying body is formed as a cylinder.

3. A toy as in claim 1, wherein said light source is inside said first design displaying body.

4. A toy as in claim 1, wherein said second design displaying body is fixedly disposed outside of said first design displaying body.

5. A toy as in claim 1, including a sound producing mechanism and a mechanism operated by the means for rotating said first design displaying body for operating said sound producing mechanism.

6. A toy for projecting two designs and superposing the same, comprising:

a body having a dial and a screen;

a window provided on top of said body;

a first transparent film positioned inside said body constituting a first design displaying body; and a second transparent film overlaying said first transparent film constituting a second design displaying body;

a light source for illuminating said first and second design displaying bodies and for projecting superimposed designs of said first and second design displaying bodies;

wherein, upon rotation of said dial, the designs of said first and second transparent films are superimposed and projected onto a desired location while said designs of said first transparent film are projected onto said screen.

7. A toy as in claim 6, wherein said first design displaying body is formed as a cylinder.

8. A toy as in claim 6, wherein said light source is inside said first design displaying body.

9. A toy as in claim 6, wherein said second design displaying body is fixedly disposed outside of said first design displaying body.

10. A toy as in claim 6, further comprising a dome-like milk white screen on which the designs of at least said first design displaying body are projected for viewing.

11. A toy as in claim 6, including a sound producing mechanism and a mechanism operated by the means for rotating said first design displaying body for operating said sound producing mechanism.

* * * * *